United States Patent [19]

Trowbridge et al.

[11] 4,171,166

[45] Oct. 16, 1979

[54] DISPERSING APPARATUS WITH GROOVED IMPELLER

[75] Inventors: Frank R. Trowbridge; Walter B. Bryan; Charles R. Price, all of Macon, Ga.

[73] Assignee: Morehouse Industries, Inc., Fullerton, Calif.

[21] Appl. No.: 918,699

[22] Filed: Jun. 26, 1978

[51] Int. Cl.[2] ..... B01F 7/26

[52] U.S. Cl. ..... 366/316; 416/236 R

[58] Field of Search ..... 366/316, 315, 317, 263, 366/139, 168, 326; 416/236 R

[56] References Cited

U.S. PATENT DOCUMENTS

| | | | |
|---|---|---|---|
| 120,849 | 11/1871 | Broyhill et al. | 416/236 R X |
| 208,211 | 9/1878 | Swasey | 416/236 R |
| 566,292 | 8/1896 | Bierstadt | 416/236 R |
| 990,546 | 4/1911 | Gross | 416/236 R X |
| 1,240,826 | 9/1917 | Davis | 366/263 |
| 2,424,679 | 7/1947 | Cowles | 366/317 |
| 2,459,224 | 1/1949 | Hendricks | 366/315 X |
| 2,952,448 | 9/1960 | Cornell | 366/139 |
| 3,100,628 | 8/1963 | Norris, Jr. | 366/317 |
| 3,318,580 | 5/1967 | Simonetti | 366/168 |
| 3,322,401 | 5/1967 | Mersch | 366/326 |
| 3,630,373 | 12/1971 | Grazen | 416/236 R |

FOREIGN PATENT DOCUMENTS

| | | | |
|---|---|---|---|
| 46-40986 | 12/1971 | Japan | 366/315 |

*Primary Examiner*—Stanley N. Gilreath

*Attorney, Agent, or Firm*—Knobbe, Martens, Olson, Hubbard & Bear

[57] ABSTRACT

A disc-like impeller for dispersing solids within liquids is formed of ultra-high molecular weight polyethylene with a plurality of radially extending grooves on each planar face to provide a long wearing product with excellent mixing results.

14 Claims, 6 Drawing Figures

FIG. 1.
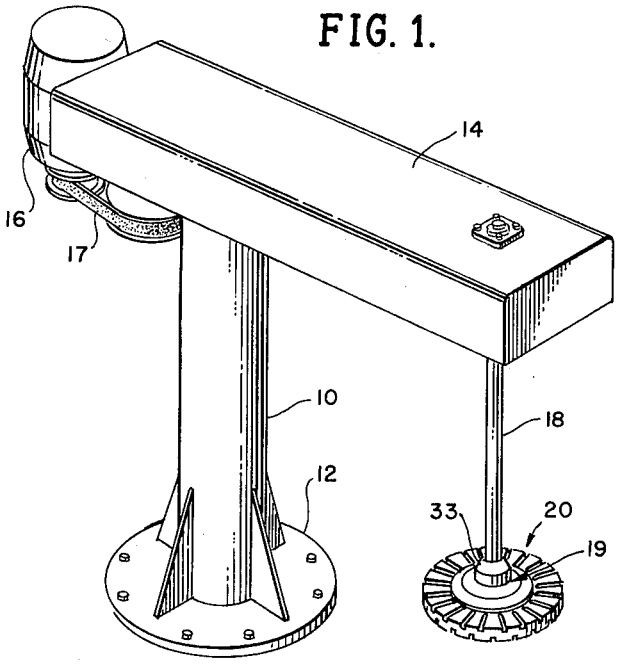
FIG. 2.
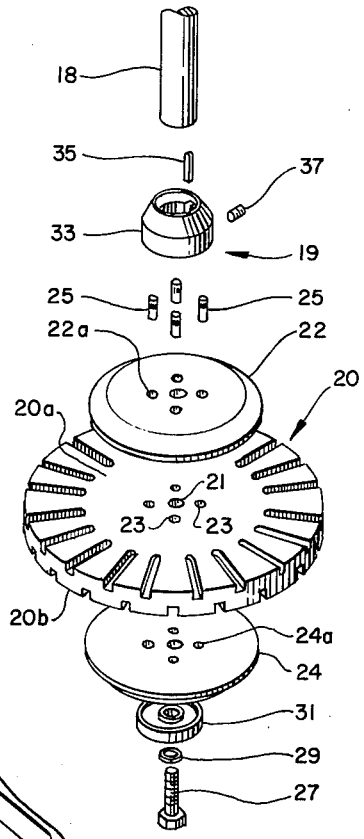
FIG. 3.
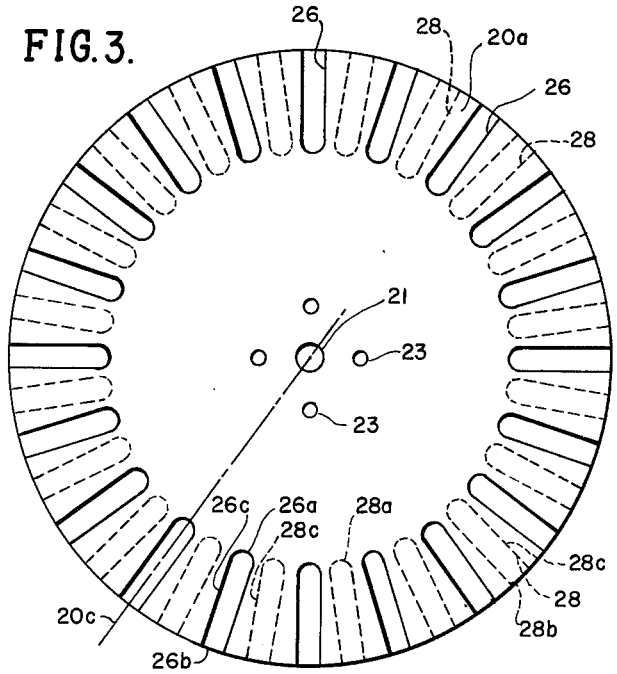
FIG. 5.
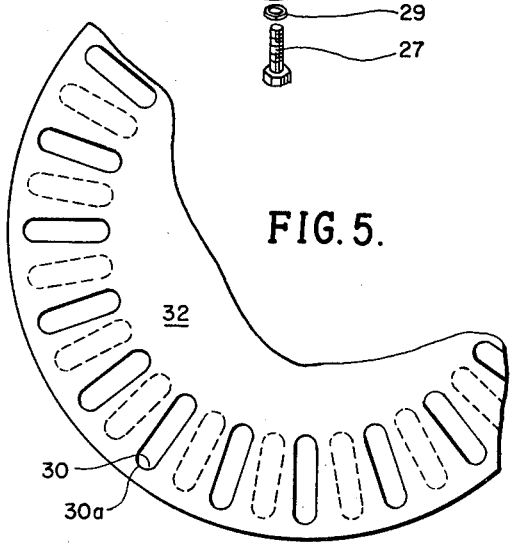
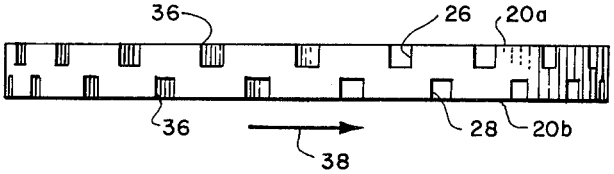
FIG. 4.
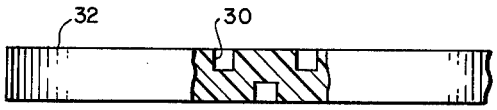
FIG. 6.

DISPERSING APPARATUS WITH GROOVED IMPELLER

This invention relates to apparatus for disseminating solids in liquids, and more particularly to rotary impellers useful in a wide variety of industrial mixing applications with such apparatus. Uniform dispersions of a finely divided solid in a liquid medium may be formed, one example of this being the mixing of pigments within paint. Pigments are frequently ground in a sandmill or other milling equipment, and prior to this operation, it is desirable to disperse the pigments in the liquid vehicle. Often it is desirable to further disperse this product in additional liquid after the milling step.

Such dispersing apparatus typically includes a shaft with a disc-like impeller mounted on the end of it. The shaft is of course rotated by a motor causing the disc to perform its desired dispersing. Typically, such impellers are made of metal and have a generally plate-like central portion with teeth-like elements that extend upwardly and downwardly on the periphery of the disc performing the mixing function. Impellers of such construction have been found to be effective in performing dispersing operations and have been widely used for many years.

One shortcoming of impellers of this type is that they have been found to wear rather quickly in mixing relatively abrasive materials. For example, in the mixing of clay-like slurrys used in making pottery, pipes or other such items, it has been found that the impellers must be frequently replaced in order to continue providing an adequate mixing job. This is not only expensive from the standpoint of the cost of the impeller but also from the standpoint of the interruption of the mixing process and of the additional labor and maintenance personnel required for making the frequent changes. There are other known impeller designs; however, for various reasons, such designs have never become widely accepted. Accordingly, a need exists for an improved impeller design which will provide adequate performance and also prove to be highly reliable and durable. Naturally such an impeller must also be reasonably priced in order to be acceptable.

In accordance with the present invention, an impeller is provided with a disc-like configuration having a plurality of radially extending grooves on each planar face of the disc. The grooves on one face of the disc are circumferentially offset with respect to the grooves on the opposite face so that a groove on one side is circumferentially between a pair of adjacent grooves on the other side. The impeller is preferably made of a plastic-like material such as polyethylene. An impeller made of such material with the grooved design has been found to provide adequate mixing results together with superior wear characteristics, being much more durable than a presently used steel impeller.

In a preferred form of the invention, the disc is supported on a shaft by the use of two circular retaining plates, one on each side of the impeller, and held in place by a retaining nut. The grooves are radially short, extending outwardly from the retaining plates and representing only about one-third of the impeller disc radius. The radially outer end of each groove may open to the periphery of the disc; or if a different flow pattern is desired, the radially outer end of the groove may be closed.

For a more thorough understanding of the invention, refer now to the following detail description and drawings in which:

FIG. 1 is a perspective view of the dispersing apparatus incorporating the impeller design of the invention;

FIG. 2 is an exploded perspective view illustrating the impeller together with the mounting structure;

FIG. 3 is an enlarged plan view of the impeller disc illustrating the arrangement of the grooves;

FIG. 4 is an edge elevational view of the impeller of FIG. 3;

FIG. 5 is a partial plan view of an alternate form of the grooves in an impeller disc; and FIG. 6 is an edge elevational, partially sectionalized view of the disc of FIG. 5.

Referring now again to FIG. 1, the representative dispersing apparatus of the invention may be seen to include a pedestal 10 having a base 12 which rests on the floor or other supporting surface, and a bridge 14 supported on the upper end of the pedestal 10 with a motor 16 mounted on one end of the pedestal and an impeller shaft 18 supported on and depending from the other end of the bridge 14. Suitable belts and other drive means 17 extend from the motor through the bridge in a known manner to rotate the impeller.

Mounted on the lower end of the impeller shaft 18 is an impeller hub assembly 19 and disc 20 which may be seen to have a generally flat circular configuration. Referring to FIG. 2, the impeller disc 20 has a central opening 21 and a series of surrounding openings 23 for mounting the impeller to the shaft and the hub assembly. The hub assembly 19 includes an upper mounting plate 22 engaging the upper axial surface **20*a* of the impeller disc and a similar plate 24 engaging the central portion of the lower side of the disc to provide strength to the assembly. A series of torque transfer pins 25 are forced into the openings 23 in the disc 20 and through similar aligned openings 22*a* and 24*a* in the mounting plates to cause the plates and the disc to rotate as a unit. A bolt 27 extends through a lock washer 29, a retaining washer 31, the plates 22 and 24, the impeller disc 20, and a collar 33, and threads into the lower end of the shaft 18 to hold the impeller and the collar on the shaft. The collar is fixed to rotate with the shaft by a key 35, and the key is axially fixed by a set screw 37 which threads into the collar 33**.

As may be seen from FIGS. 1–4, the impeller disc is formed with a plurality of grooves 26 on its upper planar face **20*a* and similar grooves 28 on its lower planar face 20*b* (hereinafter referred to as "upper and lower axial faces 20*a* and 20*b*" respectively). Each groove 26 and 28 extends radially from a point near the periphery of the mounting plates 22 and 24, which is about two-thirds out from the center, to the periphery of the disc. In other words, the radial length of a single groove is about one-third the radius of the disc. While the exact radial length of the grooves is not critical, it has been found that this is a desirable length. As shown, the grooves are relatively shallow, extending axially less than half of the axial thickness of the disc, as best shown in FIG. 4**. Also it may be seen that the grooves have a generally square cross-section, although rounded corners in the bottom of the grooves are equally effective.

The radially inner ends **26*a* and 28*a* of the grooves are rounded while the radially outer ends 26*b* and 28*b* open to the periphery of the disc. It can also be seen from the drawings that the longer sides 26*c* and 28*c* of the grooves are parallel to each other, and hence, are not precisely radially extending with respect to the disc; however, the longitudinal center line 20***c* of each groove extends radially. The grooves are equally spaced around the periphery of the disc, and, as seen from FIG. 3, the spacing between each groove, with the radial length of the grooves shown, is greater than the width of the groove. Naturally, as the grooves extend inwardly they become closer, and if extended radially sufficiently far inwardly, the spacing between the grooves would become less than the width of the groove and eventually would disappear. The number of grooves will of course vary with the size of the diameter of the disc. While the number and width of the grooves is important, it is not critical in that various approaches are effective. In the arrangement shown, twenty grooves are illustrated on one face of the disc and the radial length of each groove is about five times the circumferential width of the groove.

The grooves formed on one side of the disc are identical to those on the other side, but the grooves on one side are circumferentially offset from the grooves on the other side. Preferably a groove 26 on one side is centrally positioned between a pair of grooves 28 on the opposite side, as may be seen from FIGS. 3 and 4.

It has been found that in testing an impeller of the type shown in FIGS. 3 and 4, excellent dispersing or mixing has been obtained; and of particular importance, it has been found that an impeller of this type made of plastic type material such as ultra-high molecular weight polyethylene provides many more hours of satisfactory mixing than will an impeller made of steel having a more conventional design. The grooves provide the necessary dispersion, and the material is sufficiently resilient such that abrasive material being mixed does not cause the wear and abrasion of polyethylene that it does on a more rigid, steel impeller. Advantageously, polyethylene may be machined or molded.

In one test, a 32 inch diameter impeller was used in mixing clay and the life of the impeller was from 56 to 571 hours, depending on the percentage of sand in the clay. This is as much at ten times more life than a metal impeller. Similarly, a 4 inch blade running in sand showed ten times more life than a stainless steel blade currently being used.

FIGS. 5 and 6 illustrate a form of the invention which is essentially identical to that of FIG. 3 with the exceptions that the slots or grooves 30 are slightly shorter and do not open to the periphery of the impeller disc 32. Instead, the radially outer ends 30*a* of the grooves are rounded like the radially inner ends. Such a design provides a slightly different dispersion and also provides excellent wear characteristics.

The impeller of FIG. 3 with the grooves opening to the outer edge provide greater circulation than the grooves that terminate before the outer edge, as shown in FIG. 5. However, the closed end grooves offer greater safety with respect to operating personnel.

One of the measures of the work performed in dispersion operation is the amount of electrical power required to rotate the impeller. Thus, if a high current is required to rotate the impeller, more work is being done than if a smaller current is required. It has been observed that with an impeller of the type shown herein, the initial current requirement for rotating the impeller decreases rather quickly during the first few hours of operation of a new disc and then drops considerably more gradually, as wear continues. Referring to FIG. 4, it has been determined that it is the side of a groove facing in the direction 38 of rotation of the impeller which is the primary working area or resistance surface of the groove; and it is the wearing of an initially sharp edge or corner 36 on this primary working surface which accounts for the initial drop in the current required to rotate the impeller. Accordingly, it is practical to form this edge 36 rounded slightly so that the performance range throughout the life of an impeller is more constant. This provides a more uniform mixing pattern and allows the motor size to be matched more closely to the impeller load.

What is claimed is:

1. An industrial dispersion apparatus comprising:

impeller means rotatable to disperse a solid material in a liquid formed of a resilient disc having opposite faces disposed generally perpendicular to the axis of said disc each formed with a plurality of circumferentially spaced, radially extending grooves having opposed generally parallel sidewalls extending substantially normal to said faces and terminating at a respective face to form wearing edges, said grooves on one face being circumferentially offset with respect to the grooves on the other face so that a groove on one face is circumferentially spaced between the two adjacent grooves on the other face.

2. The apparatus of claim 1 wherein said grooves are open to the periphery of said disc.

3. The apparatus of claims 1 or 2 wherein the radial length of said grooves is about one-third of the radius of the disc.

4. The apparatus of claim 1 wherein said grooves are relatively shallow being less than one-half of the axial thickness of the impeller disc.

5. The apparatus of claim 1 wherein adjacent grooves in one face of the disc are identical to each other and are circumferentially spaced from each other a distance greater than the circumferential width of said adjacent grooves.

6. The apparatus of claim 1 wherein said grooves have a generally rectangular cross-section.

7. The apparatus of claims 1, 4 or 5 wherein the center line of each groove extends radially, and the sides of each groove extend generally parallel to said center line.

8. The apparatus of claim 1 wherein said wearing edge of each groove facing in the direction of rotation of the disc is slightly rounded.

9. The apparatus of claim 1 wherein each of said grooves are closed on both radial ends.

10. The apparatus of claim 1 wherein said disc is made of a high molecular weight abrasively tough material such as polyethylene.

11. The apparatus of claim 1 including a shaft attached to the central section of said disc extending perpendicular to said disc faces, a mounting plate attached to said shaft and positioned adjacent each axial face of said disc to provide rigidity to the disc.

12. The apparatus of claim 11 wherein said grooves extend radially outwardly from said central section and said mounting plates.

13. A dispersing impeller comprising:

disc means for dispersing a finely divided solid in a liquid medium made of a abrasively tough high molecular weight polyethelene material, said disc having a planar face disposed perpendicular to the axis of said disc with a plurality of grooves formed therein, each of said grooves including opposed axially extending generally parallel sidewalls generally normal to said face, said grooves having a radial length which is no greater than one third of the radius of the disc, and said grooves being located in the radially outer portion of the disc.

14. Apparatus for dispersing solid material in a liquid comprising a rotatable impeller formed of a resilient relatively rigid disc having opposing planar surfaces disposed generally perpendicular to the axis of said disc with a plurality of circumferentially spaced elongated grooves formed in each of said opposing surfaces, each of said grooves having a radially extending center line with the sidewalls of said grooves extending generally parallel to the center line for each groove and generally normal to said surfaces, the grooves on one planar surface of said disc being circumferentially offset with respect to the grooves on the other planar surface of the disc so that a groove on one surface is equally spaced between the two adjacent grooves on the other surface, said grooves extending radially about one-third the radius of the disc, each of said grooves having a pair of opposing sides opening to one of said planar surfaces of said disc, with the one side of said groove facing in the direction of rotation of said disc having a slightly rounded edge extending onto said one of said planar surfaces.

* * * * *